US010233526B2

(12) United States Patent
Sato et al.

(10) Patent No.: US 10,233,526 B2
(45) Date of Patent: Mar. 19, 2019

(54) FACILITY HAVING A CONTINUOUS ANNEALING FURNACE AND A GALVANIZATION BATH AND METHOD FOR CONTINUOUSLY MANUFACTURING HOT-DIP GALVANIZED STEEL SHEET

(71) Applicant: JFE STEEL CORPORATION, Tokyo (JP)

(72) Inventors: Nobuyuki Sato, Tokyo (JP); Kazuki Nakazato, Tokyo (JP); Takamasa Fujii, Chiba (JP)

(73) Assignee: JFE Steel Corporation, Tokyo (JP)

( * ) Notice: Subject to any disclaimer, the term of this patent is extended or adjusted under 35 U.S.C. 154(b) by 98 days.

(21) Appl. No.: 14/649,408

(22) PCT Filed: Dec. 4, 2012

(86) PCT No.: PCT/JP2012/007778
§ 371 (c)(1),
(2) Date: Jun. 3, 2015

(87) PCT Pub. No.: WO2014/087452
PCT Pub. Date: Jun. 12, 2014

(65) Prior Publication Data

US 2015/0315691 A1 Nov. 5, 2015

(51) Int. Cl.
*C23C 2/00* (2006.01)
*C23C 2/06* (2006.01)
(Continued)

(52) U.S. Cl.
CPC ..... *C23C 2/06* (2013.01); *C21D 1/76* (2013.01); *C21D 9/561* (2013.01); *C21D 9/573* (2013.01);
(Continued)

(58) Field of Classification Search
CPC ..... B32B 15/013; C23C 2/02; C23C 2/003; C23C 2/06
(Continued)

(56) References Cited

U.S. PATENT DOCUMENTS 3,778,221 A * 12/1973 Bloom ..... C21D 1/74 266/250
4,415,382 A * 11/1983 Gaskey ..... C21D 9/573 148/661
(Continued)

FOREIGN PATENT DOCUMENTS

EP 2653572 10/2013
JP 04116127 4/1992
(Continued)

OTHER PUBLICATIONS

International Search Report for International Application No. PCT/JP2012/007778 dated Mar. 5, 2013.
(Continued)

*Primary Examiner* — Karl Kurple
(74) *Attorney, Agent, or Firm* — RatnerPrestia

(57) ABSTRACT

A facility for continuously manufacturing a galvanized steel sheet includes a continuous annealing furnace, a snout, and a galvanization bath. The furnace is divided into a heating zone, a soaking zone, and a cooling zone. The bath is directly connected to the furnace through the snout. The facility has a dewpoint meter and a spray port and a suction port for a furnace gas that are provided in at least one of the zones, gas cyclic paths which connect the spray port and the suction port to a refiner, and a dewpoint meter and a humidification device that are provided in the snout. The gas cyclic paths are separately formed for the respective connected zones. The refiner functions so that a measured value of the dewpoint meter is equal to a target dewpoint, and the humidification device functions so that a measured value of
(Continued)

the dewpoint meter in the snout is equal to a target dewpoint for the snout.

6 Claims, 4 Drawing Sheets

(51) Int. Cl.

| | |
|---|---|
| ***C23C 2/02*** | (2006.01) |
| ***C22C 38/00*** | (2006.01) |
| ***C21D 9/56*** | (2006.01) |
| ***C23C 2/40*** | (2006.01) |
| ***C21D 1/76*** | (2006.01) |
| ***C21D 9/573*** | (2006.01) |

(52) U.S. Cl.
CPC ..... *C21D 9/5735* (2013.01); *C22C 38/00* (2013.01); *C23C 2/003* (2013.01); *C23C 2/02* (2013.01); *C23C 2/40* (2013.01)

(58) Field of Classification Search
USPC ..... 266/44; 427/321
See application file for complete search history.

(56) References Cited

U.S. PATENT DOCUMENTS 4,557,953 A * 12/1985 Boston ..... C23C 2/02 427/321
4,584,211 A * 4/1986 Higuchi ..... C23C 2/12 427/320
5,358,744 A * 10/1994 Buscarlet ..... C23C 2/12 427/320
5,447,754 A * 9/1995 Jasper ..... C23C 2/02 427/320
5,827,618 A * 10/1998 Oyagi ..... C23C 2/02 148/530
6,093,452 A * 7/2000 Ishii ..... C23C 2/02 427/319
6,224,692 B1 * 5/2001 Cantacuzene ..... C23C 2/02 148/533
9,759,491 B2 * 9/2017 Takahashi ..... F27D 7/06
2001/0032687 A1 * 10/2001 Antoni ..... B01J 35/02 148/531
2003/0091857 A1 * 5/2003 Pradhan ..... B32B 15/013 428/659
2004/0033386 A1 * 2/2004 Pradhan ..... B32B 15/013 428/659
2007/0051438 A1 * 3/2007 Honda ..... C21D 1/76 148/533
2009/0123651 A1 * 5/2009 Okada ..... C23C 2/28 427/319
2010/0200126 A1 * 8/2010 Onozawa ..... C21D 1/40 148/533
2013/0273251 A1 10/2013 Takahashi
2015/0013851 A1 * 1/2015 Takahashi ..... C23C 2/02 148/508
2015/0076751 A1 * 3/2015 Fujii ..... F27D 7/04 266/44
2015/0114528 A1 * 4/2015 Fujii ..... C21D 9/52 148/655
2015/0140218 A1 * 5/2015 Takahashi ..... C23C 2/02 427/321

FOREIGN PATENT DOCUMENTS

| | | |
|---|---|---|
| JP | 09324210 | 12/1997 |
| JP | 10176225 | 6/1998 |
| JP | 11236623 | 8/1999 |
| JP | 2003328098 | 11/2003 |
| JP | 2012017495 | 1/2012 |
| JP | 2012126983 | 7/2012 |
| WO | 2012081719 | 6/2012 |

OTHER PUBLICATIONS

Chinese Office Action for Chinese Application No. 201280077492.3, dated May 5, 2016, with Concise Statement of Relevance, 15 pages.
English language Concise Statement of Relevance of Korean Office Action for Application No. 2015-7015564, 1 page.
Extended European Search Report for EP Application No. 12889434.2-1362 dated Dec. 9, 2015.

* cited by examiner

FACILITY HAVING A CONTINUOUS ANNEALING FURNACE AND A GALVANIZATION BATH AND METHOD FOR CONTINUOUSLY MANUFACTURING HOT-DIP GALVANIZED STEEL SHEET

CROSS REFERENCE TO RELATED APPLICATIONS

This is the U.S. National Phase application of PCT/JP2012/007778, filed Dec. 4, 2012, the disclosure of this application being incorporated herein by reference in its entirety for all purposes.

FIELD OF THE INVENTION

The present invention relates to a facility and method for continuously manufacturing a hot-dip galvanized steel sheet.

BACKGROUND OF THE INVENTION

A facility for continuously manufacturing a hot-dip galvanized steel sheet conventionally includes galvanization performed by continuously annealing a steel strip, which is a strip-shaped steel sheet, using a continuous annealing furnace and by subsequently feeding the annealed steel strip into a plating bath of zinc or zinc alloy directly through a snout on the exit side of the continuous annealing furnace. The continuous annealing furnace commonly includes a heating zone in which a steel sheet that is being transported through an airtight furnace is heated to a temperature of about 800° C. to 1000° C. in a high-temperature gas atmosphere and a cooling zone in which the heated steel sheet is cooled to a temperature of about 300° C. to 600° C. by spraying a low-temperature gas. There is also a continuous annealing furnace having a soaking zone, in which the heated steel strip is soaked, subsequent to the heating zone. There is also a continuous annealing furnace having a preheating zone, in which the steel strip which has not been heated is preheated, prior to the heating zone.

Patent Literature 1 describes a bright annealing furnace, which is a facility having only a furnace without a snout, provided with a ventilation pipe which is placed at the boundary of an interior refractory and an exterior steel shell of the furnace wall. The gas inside the furnace is discharged to the outside of the furnace through the ventilation pipe, and a furnace gas circulation device, into which the discharged gas is suctioned in order to clean the gas by removing impurities in the gas and from which the cleaned gas is returned into the furnace, is additionally installed outside the furnace. Thereby, in particular, a seasoning time, or the time required to start up a new furnace at the beginning of its operation or to start up a repaired furnace when the furnace is resumed to operate, is significantly decreased.

Patent Literature 2 describes a technique using an apparatus for continuous annealing in a reducing atmosphere, which is an apparatus having only a furnace without a snout, for a metal strip. A refiner, which is a moisture removing device and is referred to as a refining device in Patent Literature 2, is utilized. Thereby, the cooling efficiency is increased by spraying the gas in a preheating zone, which provided prior to a heating zone, into a cooling zone, or the preheating efficiency is increased by conversely spraying the gas in the cooling zone into the preheating zone.

PATENT LITERATURE

PTL 1: Japanese Unexamined Patent Application Publication No. 4-116127

PTL 2: Japanese Unexamined Patent Application Publication No. 11-236623

SUMMARY OF THE INVENTION

In the case of a facility for continuously manufacturing a galvanized steel sheet, it is necessary that a dewpoint is lowered by removing moisture in a continuous annealing furnace in order to increase zinc coatability, or adhesiveness of a galvanized or galvannealed film to the surface of a steel sheet. Accordingly, the dewpoint is conventionally controlled by suctioning the furnace gas from the cooling zone, removing the moisture from the gas by using a refiner, which is installed outside the furnace, and then returning the gas into the heating zone. With this method, however, it is difficult to stably achieve high zinc coatability. The reason for that will be described hereafter.

Although it is known that adding Si, Mn, or the like is effective in order to increase the strength of a steel material, Si and Mn are zinc coatability-deteriorating elements. Accordingly, there are limits to the amounts of Si and Mn added to steel for a galvanized steel sheet. FIG. 2 is a schematic diagram illustrating the relationship between the surface oxidation amounts of the zinc coatability-deteriorating elements and the dewpoint of the furnace atmospheric gas obtained from the results of the experiments and investigations conducted by the present inventors. In a common dewpoint range, in which the operation is conventionally performed, surface oxidation amount tends to be large, and the degree of surface concentration of the zinc coatability-deteriorating elements tends to increase with an increase in the annealing temperature. However, as illustrated in FIG. 2, since surface concentration of the zinc coatability-deteriorating elements is suppressed by decreasing the dewpoint in the furnace, it is possible to achieve satisfactory zinc coatability even when annealing is performed at a high temperature. That is to say, in the common dewpoint range, it is difficult to suppress surface concentration of the zinc coatability-deteriorating elements and, hence, zinc coatability deteriorates. For example, the relationship between the degree of surface concentration of each element of a steel sheet containing 1.5 mass % of Si or 2.0 mass % of Mn in steel and a dewpoint in the furnace was investigated. It was clarified that there was a significant decrease in the degree of surface concentration of Mn at the dewpoint of −45° C. or lower and that there was a significant decrease in the degree of surface concentration of Si at the dewpoint of −50° C. or lower. That is, it was necessary to control the dewpoint in the furnace to be −50° C. or lower in order to stably achieve high zinc coatability by suppressing surface concentration of Si and Mn. However, the dewpoint can only be lowered to about −40° C. using the method described above in which the gas in the furnace is suctioned from the cooling zone so as to remove moisture using a refiner provided outside the furnace and then returned to the heating zone. Therefore, it was difficult to stably achieve high zinc coatability.

On the other hand, in the case of a continuous galvanization facility which has a galvanization bath, there was a problem related to the dewpoint of an atmospheric gas in a snout. That is, in the case where the dewpoint in the snout is significantly lowered along with a lowered dewpoint in the furnace, since molten zinc is vaporized, the vaporized zinc attaches to a steel strip, which results in poor product quality.

As described above, in the case of a conventional continuous facility for manufacturing a galvanized steel sheet, it was difficult to stably achieve satisfactory zinc coatability because it is not possible to control the dewpoint of a continuous annealing furnace to be −50° C. or lower. Furthermore, the product quality was degraded as a result of molten zinc vaporized in the snout attaching to a steel strip in the case where the dewpoint in the furnace is lowered. Accordingly, there was a problem in that satisfactory galvanized product quality and zinc coatability are not stably achieved.

The present inventors diligently conducted investigations and has completed the present invention, which includes the following aspects.

(1) A facility for continuously manufacturing a galvanized steel sheet, which includes a continuous annealing furnace divided into three zones including a heating zone that heats a steel strip which is a strip-shaped steel sheet to be passed through the furnace, a soaking zone that soaks the heated steel strip, and a cooling zone that cools the soaked steel strip, which are arranged in this order from an upstream side of a transport path; a galvanization bath; a snout that directly connects the furnace to the galvanization bath therethrough, the snout being a closed space through which the steel strip is directly fed into the galvanization bath from the furnace; a first dewpoint meter and a suction port and a spray port for a gas within the furnace that are provided in at least one of the three zones of the furnace; a gas cyclic path that connects the spray port and the suction port to a refiner, which is a moisture removing device provided outside the furnace, separately formed for each of the connected zones; and a second dewpoint meter and a humidification device, which humidifies an inside of the snout, that are provided in the snout. The refiner functions so that, for each of the gas cyclic paths, a first measured value of the first dewpoint meter in the connected zone is equal to a first target dewpoint; and the humidification device functions so that a second measured value of the second dewpoint meter in the snout is equal to a second target dewpoint for the snout.

(2) The facility for continuously manufacturing a galvanized steel sheet according to item (1), which further includes a snout suction port and a snout spray port for a gas within the snout that are provided in the snout, and a snout gas cyclic path formed between the refiner and the snout by connecting the ports thereof to the refiner. The refiner functions along with the humidification device so that the second measured value of the second dewpoint meter in the snout is equal to the second target dewpoint for the snout.

(3) A method for continuously manufacturing a galvanized steel sheet using the facility for continuously manufacturing a galvanized steel sheet according to item (1) or (2), in which a galvanization operation is performed while setting the first target dewpoint of the furnace to −50° C. or lower and −80° C. or higher and the second target dewpoint of the snout to −35° C. or higher and −10° C. or lower.

According to the present invention, it is possible to stably achieve high galvanized product quality and high zinc coatability.

DETAILED DESCRIPTION OF EMBODIMENTS OF THE INVENTION

Figure 1:
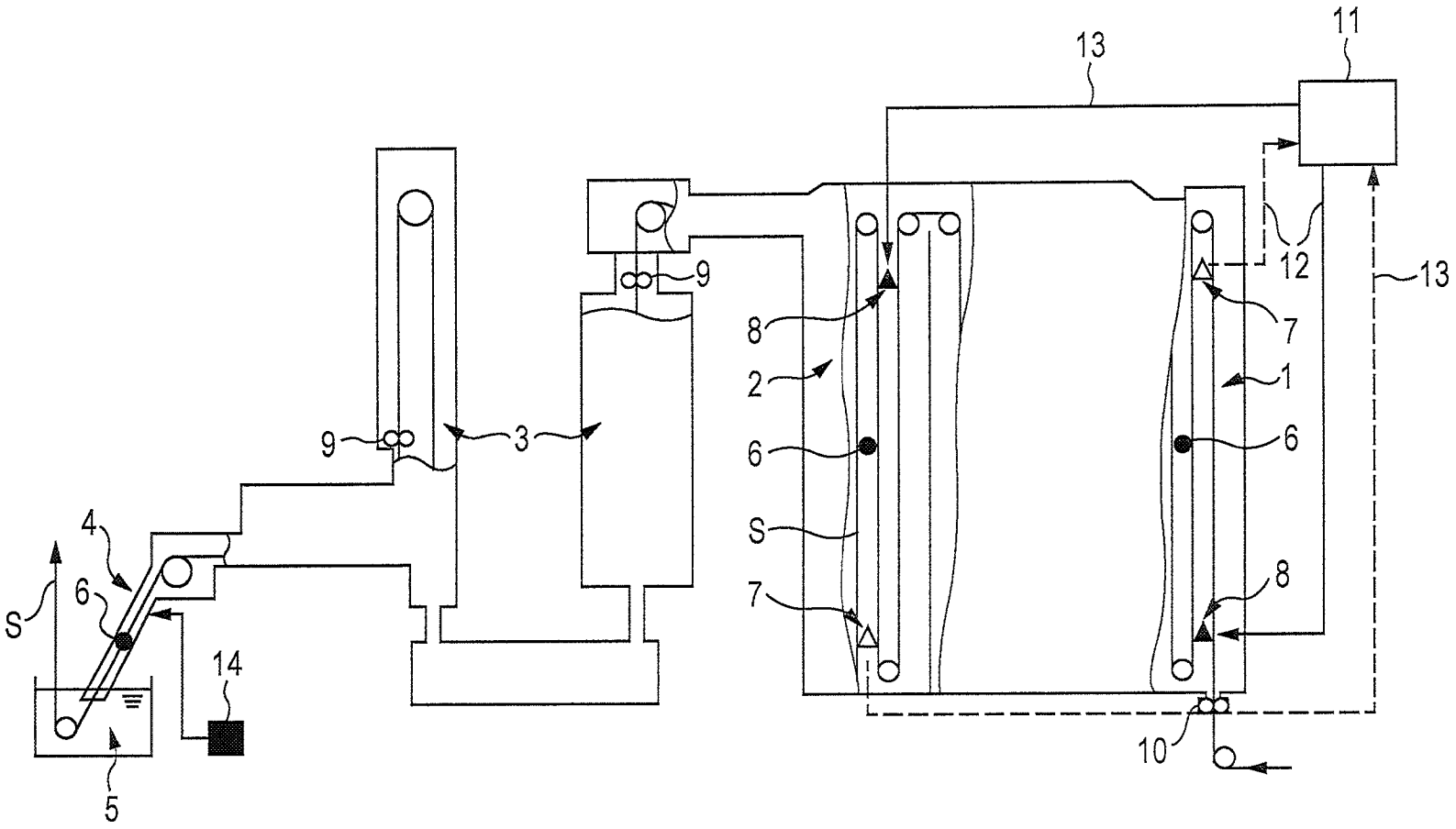
FIG. 1 is a schematic diagram illustrating an embodiment of the present invention.
Figure 2:
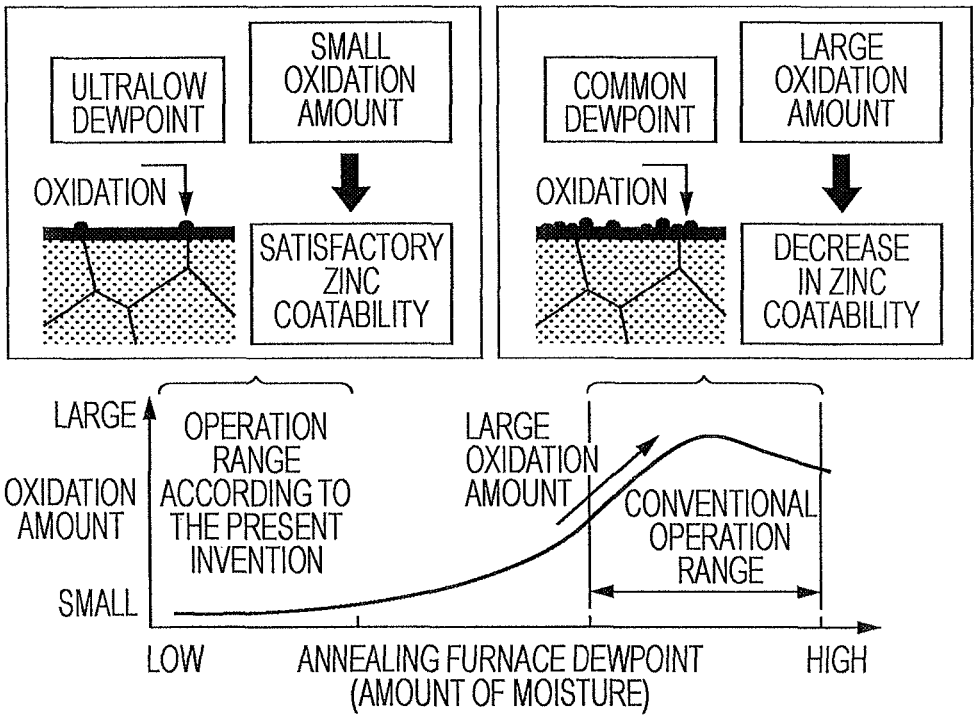
FIG. 2 is a schematic diagram illustrating the relationship between the surface oxidation amounts of zinc coatability-deteriorating elements and the dewpoint of a furnace atmospheric gas.

As illustrated in, for example, FIG. 1, embodiments of the present invention are premised on a facility including a continuous annealing furnace, a snout 4, and a galvanization bath 5. The furnace is divided into three zones, i.e., a heating zone 1 for heating a steel strip S, which is a strip-shaped steel sheet that is passed through the furnace, a soaking zone 2 for soaking the heated steel strip, and a cooling zone 3 for cooling the soaked steel strip, which are arranged in this order from the upstream side of a transport path. The bath is directly connected to the furnace through the snout, which is a closed space through which the steel strip is directly fed into the galvanization bath from the furnace. There are seal rolls 9 provided at pivotal points between the cooling zone 3 and the snout 4 in order to prevent the atmospheric gases of the different treatment sections from mixing with each other, and there are seal rolls 10 provided at the entrance of the heating zone 1 in order to prevent outer air from entering the furnace. There is also a case where a heater is provided in a part on the downstream side of the cooling zone 3 in order to perform an over-aging treatment. Such a premise is within a range of a well-known technique.

Under such a premise, aspects of the present invention include a facility including: (i) a dewpoint meter 6 and a suction port 7 and a spray port 8 of the furnace gas provided in at least one of the three zones (two zones which are the heating zone 1 and the soaking zone 2 in the present example); (ii) a refiner 11, which is a moisture removing device provided outside the furnace; (iii) gas cyclic paths 12 and 13, which connect the suction ports and the spray ports to the refiner 11, separately formed for the respective connected zones; (iv) and a dewpoint meter 6 and a humidification device 14 for humidifying the inside of the snout 4 provided in the snout 4 (as indicated by arrow in FIG. 1). In the facility, the refiner 11 functions so that, for each of the gas cyclic paths, a measured value of the dewpoint meter in the connected zone is equal to a target dewpoint, and the humidification device 14 functions so that a measured value of the dewpoint meter 6 in the snout 4 is equal to a target dewpoint for the snout 4.

Figure 4:
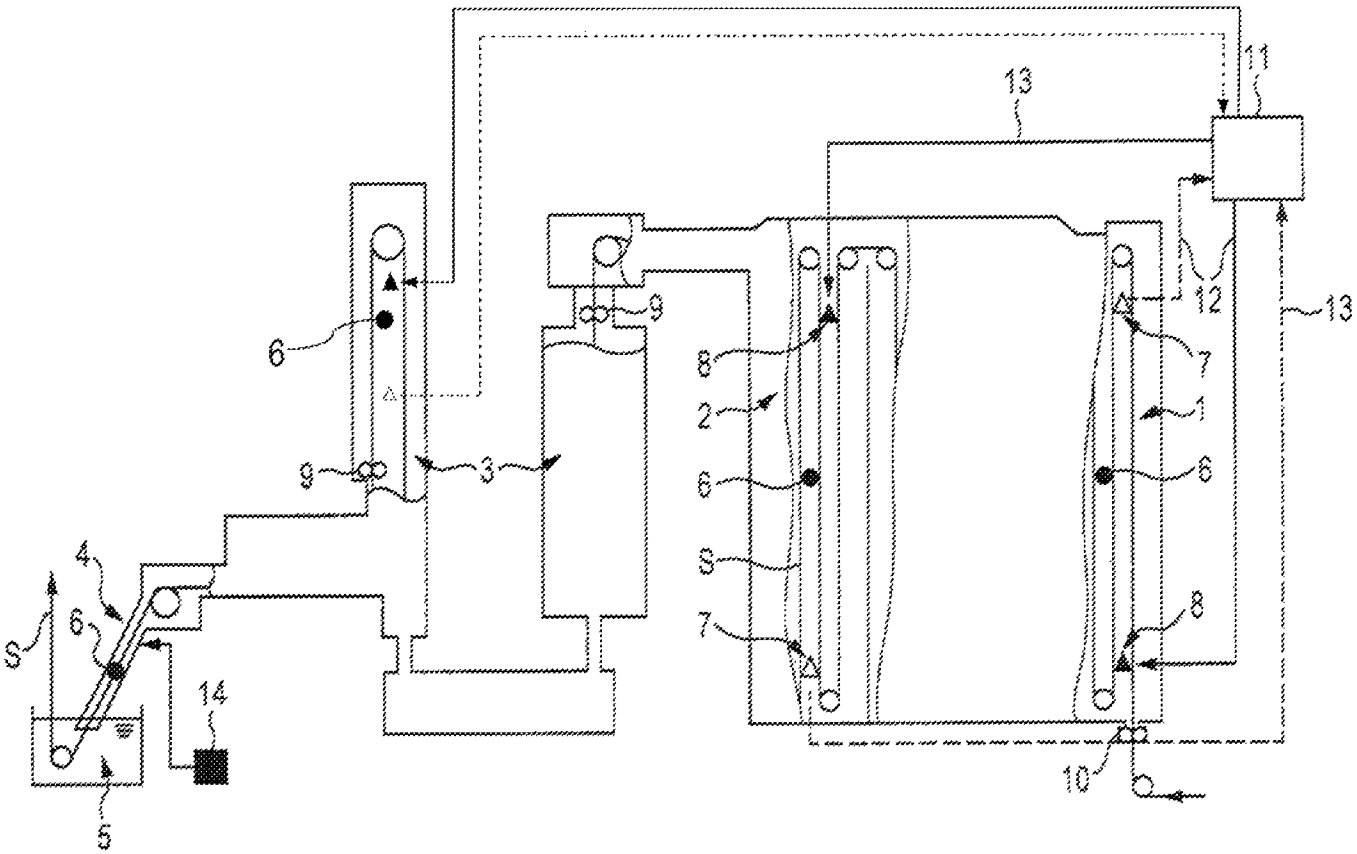
FIG. 4 is a schematic diagram illustrating an alternative emboli ent of the present invention.

Here, a pair of a suction port 7 and a spray port 8 is provided in each of the heating zone 1 and the soaking zone 2 in FIG. 1. FIG. 4 illustrates an alternative embodiment in which a suction port and a spray port are provided in each of the three zones of the furnace, including the cooling zone 3. Because it is easier to control the dewpoint when a plural pairs is provided, however, two or more pairs of suction ports 7 and spray ports 8 may be provided in each zone, and the number of pairs is appropriately determined in order to achieve the target dewpoint.

The gas cyclic paths 12 and 13, which are connected to different zones, are independent of each other and do not join together in the refiner 11. The refiner 11 functions, for each of the gas cyclic paths, to remove moisture in the gas in the gas cyclic path in order to control the dewpoint measured by the dewpoint meter of the zone to which the gas cyclic path is connected to be equal to a target dewpoint. On the other hand, the humidification device 14 functions so that humidification is performed by feeding moisture in the snout in order to control a dewpoint measured by the dewpoint meter in the snout to be equal to a target dewpoint, which is higher than that of the zone in the furnace.

As described above, some of the gas from the zones of the furnace is suctioned and is sprayed back to the same zones after removing moisture, and humidification in the snout is performing using a humidification device. Accordingly, it is possible to stably control the dewpoint in the furnace to be low, i.e., −50° C. or lower, and it is also possible to separately control the dewpoint in the furnace and the dewpoint in the snout. Thereby it is possible to stably achieve high quality and high zinc coatability for a galvanized steel sheet.

The dewpoint meter 6, the suction port 7, and the spray port 8 may be provided in at least one of the three zones of the furnace. However, it is preferable to provided these devices in the soaking zone 2. The soaking zone 2 is a zone in which surface concentration of Si and Mn likely to occur due to higher furnace temperature than in the other zones. Accordingly, it is suitable to control the dewpoint to be low by preferentially placing the dewpoint meter, the suction port, and the spray port in this zone in order to stably achieve high zinc coatability. Here, it is needless to say that it is most preferable to provide these devices in all of the three zones.

Figure 3:
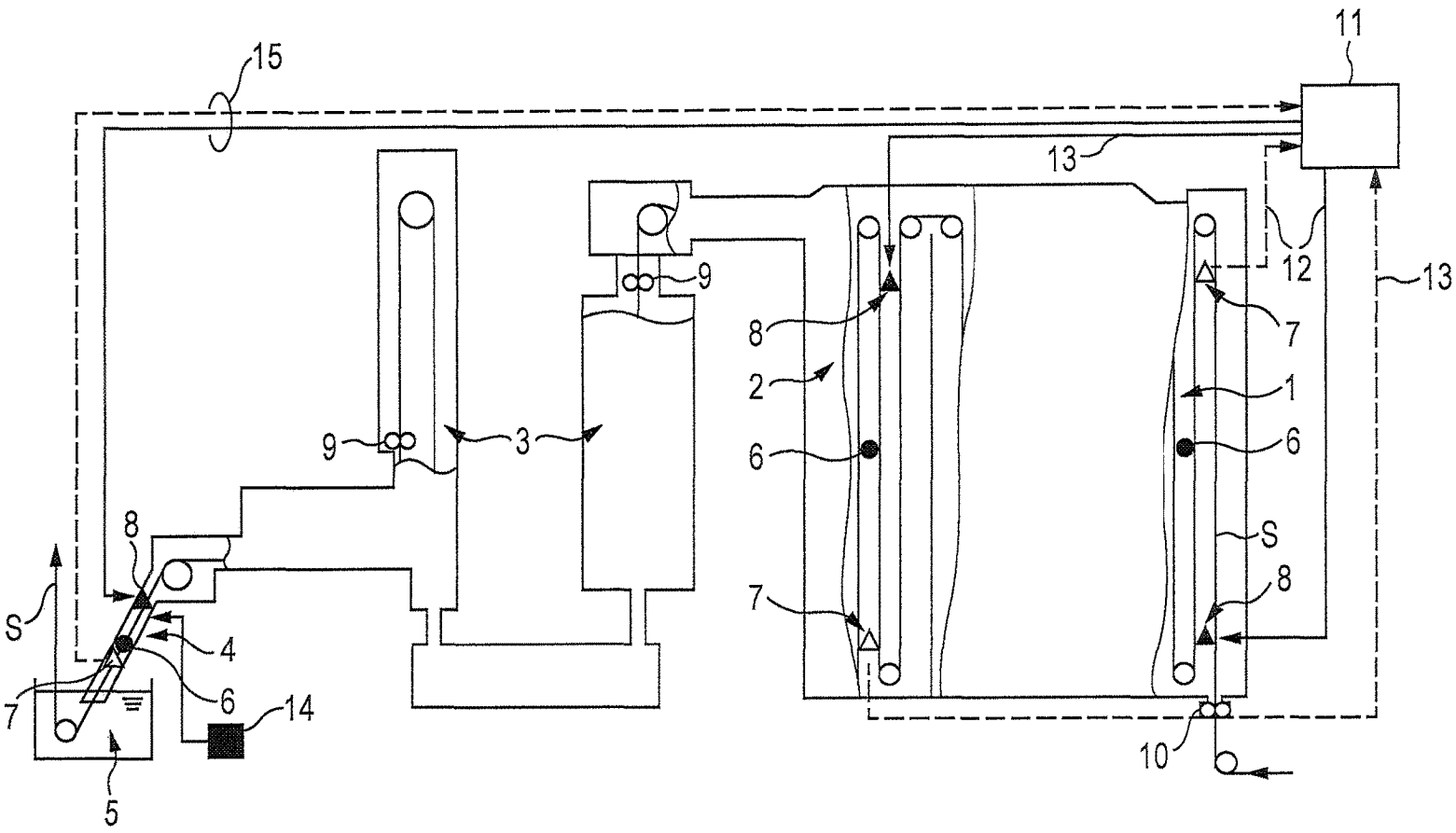
FIG. 3 is a schematic diagram illustrating an embodiment of the present invention, which is different from the one illustrated in FIG. 1.

In the case of the example illustrated in FIG. 3, in addition to the example illustrated in FIG. 1, the facility further includes a suction port 7 and a drawing port 8 for the gas in the snout provided in the snout 4, and a gas cyclic path 15 between the refiner 11 and the snout formed by connecting these ports to the refiner 11. In the facility, the refiner 11 also functions along with the humidification device 14 so that a dewpoint measured by the dewpoint meter in the snout is equal to a target dewpoint for the snout. Using this facility, it is possible to control the dewpoint in the snout with increased accuracy. Accordingly, it is possible to prevent the attachment of vaporized zinc in the snout more effectively, which results in high galvanized product quality achieved with significantly increased stability.

In a galvanization operation using the facility according to aspects of the present invention, it is preferable that, as described above, the target dewpoint in the furnace is set to be −50° C. or lower in order to suppress surface concentration of Si and Mn. Using the facility according to aspects of the present invention achieves such control for a low dewpoint, and it becomes possible to effectively prevent surface concentration of Si and Mn and stably achieve high zinc coatability. Here, because there is a significant increase in cost in order to lower the dewpoint to lower than −80° C., it is preferable that the dewpoint is −80° C. or higher. On the other hand, it is possible to control the dewpoint in the snout independently of the dewpoint in the furnace by using the facility according to aspects of the present invention. It is preferable that the target dewpoint in the snout is −35° C. or higher in order to effectively prevent vaporized zinc from attaching to a steel strip in the snout. However, it is preferable that the target dewpoint is −10° C. or lower because, in the case where the dewpoint is excessively high, a zinc oxide film is formed on the bath surface, which is disadvantageous in that the film attaches to a steel strip.

Here, among examples of the refiner, refiners having strong dehumidification capability such as desiccant-type ones which continuously perform dehumidification using, for example, calcium oxide, zeolite, silica gel, calcium chloride, or the like and compressor-type ones, which use, for example, substitute chlorofluorocarbon, are preferably used.

EXAMPLES OF THE PRESENT INVENTION

An EXAMPLE in which aspects of the present invention was applied to a continuous line for manufacturing a galvanized steel sheet in the embodiment similar to the example illustrated in FIG. 3 will be described. In this line, conventionally, a dewpoint in the furnace was controlled using a method in which furnace gas was suctioned from a cooling zone, moisture was removed using a refiner provided outside of the furnace, and then the gas was returned to a heating zone. However, the lower limit of achievable dewpoint in the furnace was about −40° C., and the dewpoint was not controlled in the snout. Therefore, in the operation of the galvanization of a high-strength steel sheet to which Si and Mn are added, the control was not satisfactorily effective for suppressing bare spots and poor surface quality. In contrast, in the case of EXAMPLE, it was possible to stably control the dewpoint in the soaking zone to be −50° C. or lower and −80° C. or higher, and it was possible to stably control the dewpoint in the snout to be −35° C. or higher and −10° C. or lower. As a result, the occurrence frequency of bare spots was significantly decreased to 10, and the occurrence frequency of poor surface quality was significantly decreased to 20 when the conventional occurrence frequency of bare spots was defined as 100, which indicates a significant effect of aspects of the present invention.

REFERENCE SIGNS LIST

1 heating zone
2 soaking zone
3 cooling zone
4 snout
5 galvanization bath
6 dewpoint meter
7 suction port
8 spray port
9, 10 seal roll
11 refiner (moisture removing device)
12, 13, 15 gas cyclic path
14 humidification device
S steel strip

The invention claimed is:

1. A facility for continuously manufacturing a galvanized steel sheet, comprising:

a furnace, said furnace is a continuous annealing furnace divided into three zones including a heating zone that heats a steel strip in form of a strip-shaped steel sheet to be passed through the furnace, a soaking zone that soaks the steel strip which has been heated in the heating zone, and a cooling zone that cools the steel strip which has been soaked in the soaking zone, which are arranged in this order heating zone, soaking zone, cooling zone from an upstream side of a transport path;

a galvanization bath;

a snout that directly connects the furnace to the galvanization bath therethrough, the snout being a closed space through which the steel strip is directly fed into the galvanization bath from the furnace;

a first dewpoint meter, a suction port, and a spray port for a gas within the furnace are provided in each of the heating zone and the soaking zone of the furnace;

a refiner, which is a moisture removing device provided outside the furnace, a plurality of gas cyclic paths, including a gas cyclic path that connects the suction port and the spray port of the heating zone to the refiner and a gas cyclic path that connects the suction port and the spray port of the soaking zone to the refiner, the plurality of gas cyclic paths being separate from one another along their entire respective lengths and a second dewpoint meter and a humidification device, which are provided in the snout, the humidification device which humidifies an inside of the snout, wherein:

the refiner functions so that, for each of the gas cyclic paths, a first measured value of the first dewpoint meter in the heating zone is equal to a first target dewpoint in the heating zone and a first measured value of the first dewpoint meter in the soaking zone is equal to a first target dewpoint in the soaking zone; and the humidification device functions so that a second measured value of the second dewpoint meter in the snout is equal to a second target dewpoint for the snout.

2. The facility for continuously manufacturing a galvanized steel sheet according to claim 1, further comprising a snout suction port and a snout spray port for a gas within the snout that are provided in the snout, and a snout gas cyclic path formed between the refiner and the snout by connecting the ports thereof to the refiner, wherein the refiner functions along with the humidification device so that the second measured value of the further dewpoint meter in the snout is equal to the second target dewpoint for the snout.

3. The facility for continuously manufacturing a galvanized steel sheet according to claim 1, wherein the second target dewpoint for the snout is −35° C. or higher.

4. A facility for continuously manufacturing a galvanized steel sheet, comprising:

a furnace, said furnace is a continuous annealing furnace divided into three zones including a heating zone that heats a steel strip in form of a strip-shaped steel sheet to be passed through the furnace, a soaking zone that soaks the steel strip which has been heated in the heating zone, and a cooling zone that cools the steel strip which has been soaked in the soaking zone, which are arranged in this order heating zone, soaking zone, cooling zone from an upstream side of a transport path;

a galvanization bath;

a snout that directly connects the furnace to the galvanization bath therethrough, the snout being a closed space through which the steel strip is directly fed into the galvanization bath from the furnace;

a first dewpoint meter, a suction port, and a spray port for a gas within the furnace are provided in each of the heating zone and the soaking zone of the furnace;

a refiner, which is a moisture removing device provided outside the furnace, a plurality of gas cyclic paths, including a gas cyclic path that connects the suction port and the spray port of the heating zone to the refiner, a gas cyclic path that connects the suction port and the spray port of the soaking zone to the refiner, and a gas cyclic path that connects the suction port and the spray port of the cooling zone to the refiner, the plurality of gas cyclic paths being separate from one another along their entire respective lengths; and a second dewpoint meter and a humidification device, which are provided in the snout, the humidification device which humidifies an inside of the snout, wherein:

the refiner functions so that, for each of the plurality of gas cyclic paths, a first measured value of the first dewpoint meter in the heating zone, is equal to a first target dewpoint in the heating zone, a first measured value of the first dewpoint meter in the soaking zone is equal to a first target dewpoint in the soaking zone, and a first measured value of the first dewpoint meter in the cooling zone is equal to a first target dewpoint in the cooling zone; and the humidification device functions so that a second measured value of the second dewpoint meter in the snout is equal to a second target dewpoint for the snout.

5. The facility for continuously manufacturing a galvanized steel sheet according to claim 4, further comprising a snout suction port and a snout spray port for a gas within the snout that are provided in the snout, and a snout gas cyclic path formed between the refiner and the snout by connecting the ports thereof to the refiner, wherein the refiner functions along with the humidification device so that the second measured value of the further dewpoint meter in the snout is equal to the second target dewpoint for the snout.

6. The facility for continuously manufacturing a galvanized steel sheet according to claim 4, wherein the second target dewpoint for the snout is −35° C. or higher.

* * * * *